United States Patent [19]

Shields

[11] Patent Number: 4,470,630

[45] Date of Patent: Sep. 11, 1984

[54] PORTABLE FOLDING CHAIR

[76] Inventor: Michael P. Shields, 18618 Collins St., Apt. 115, Tarzana, Calif. 91356

[21] Appl. No.: 360,806

[22] Filed: Mar. 22, 1982

[51] Int. Cl.[3] ..... A47C 13/00; A47C 5/10

[52] U.S. Cl. ..... 297/118; 297/3; 297/21; 297/39; 297/184; 5/419; 5/433

[58] Field of Search ..... 297/118, 3, 17, 39, 297/115, 116, 130, 184, 354, 355, 377, 21; 5/417, 418, 419, 420, 432, 433

[56] References Cited

U.S. PATENT DOCUMENTS

| | | | |
|---|---|---|---|
| 224,272 | 2/1880 | Buell | 297/118 |
| 470,255 | 3/1892 | Petrie | 297/118 X |
| 2,638,970 | 5/1953 | Harber | 297/39 |
| 2,816,599 | 12/1957 | Adams | 5/419 X |
| 3,050,280 | 8/1962 | Regan | 297/184 X |
| 3,279,734 | 10/1966 | Kramer | 297/39 X |
| 4,100,633 | 7/1978 | Pintos | 297/184 X |
| 4,375,901 | 3/1983 | MacDonald | 5/419 X |

FOREIGN PATENT DOCUMENTS

| | | | |
|---|---|---|---|
| 156623 | 5/1954 | Australia | 297/21 |
| 1142544 | 9/1957 | France | 297/355 |
| 1173757 | 3/1959 | France | 5/432 |

*Primary Examiner*—William E. Lyddane
*Assistant Examiner*—Peter R. Brown
*Attorney, Agent, or Firm*—Lyon & Lyon

[57] ABSTRACT

A portable folding chair which is adaptable for use in an upright conventional sitting mode, in an inverted position as a back rest and in a collapsed position as a carrying device. The rear leg member and chair back are adjustable so that the rear leg member defines a comfortable headrest in the inverted backrest mode and a flap is provided which defines a lounging mat in the back rest mode which, in use, anchors the chair in place and in the collapsed carrying mode defines with the seat and back panels a covered carriage compartment.

9 Claims, 14 Drawing Figures

FIG. 3.
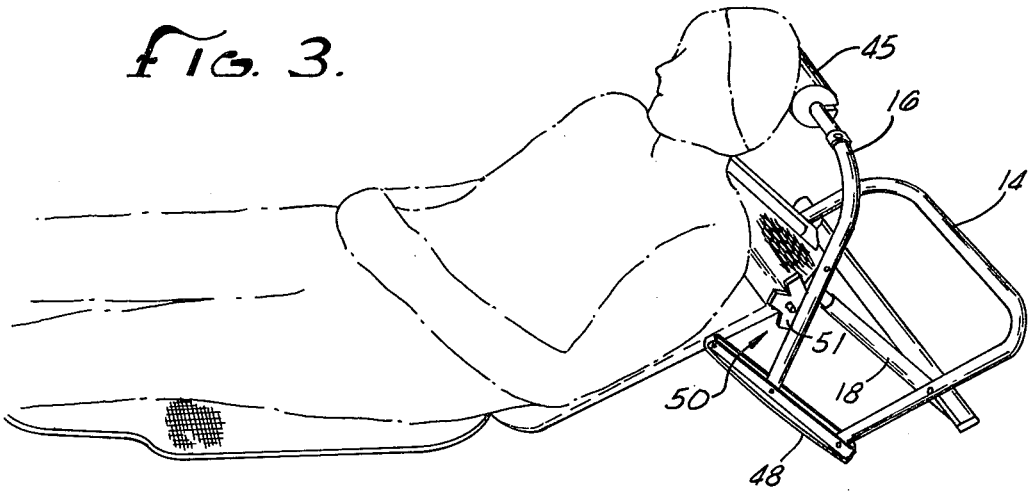
FIG. 4.
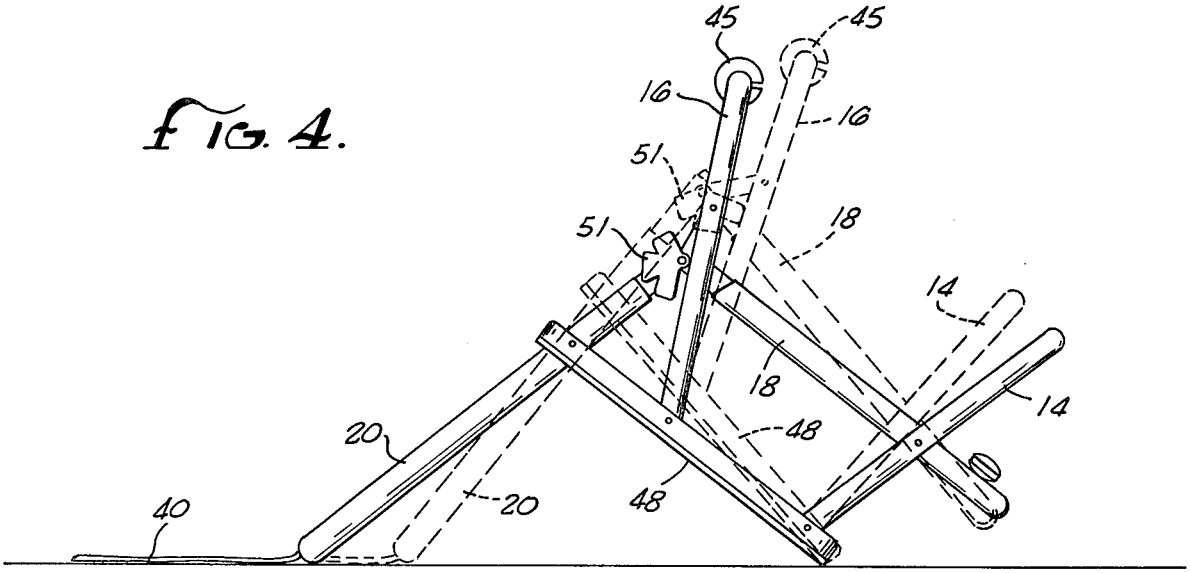
FIG. 5a.
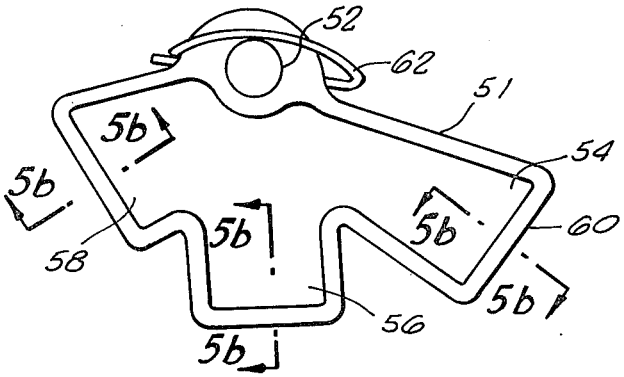
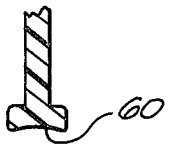
FIG. 5b.

PORTABLE FOLDING CHAIR

BACKGROUND OF THE INVENTION

The present invention relates to folding chairs and more particularly, to a highly versitile multi-configuration portable folding chair. Portable folding chairs are well-known and are commonly used for sitting and sunning and are very popular on sandy beaches. Bringing a chair to the beach or other recreational area, however, creates certain problems. Such chairs must be lightweight and compact. The person carrying the chair is often also carrying towels, clothing, lotions, reading materials and perhaps a bulky or awkward umbrella. To facilitate carrying of all these items, some users of existing folding chairs have tried to put their towels and other items between the folded seat and back of their chairs. However, the use of such chairs as a storage and carrying means is quite limited and cumbersome and often results in the chair unfolding and spilling its contents.

When using folding chairs at the beach, many people unfold a separate umbrella and set it up in the sand to keep all or part of their bodies in the shade. The use of such sun umbrellas is becoming more widespread in light of information that excessive exposure to the sun may cause skin cancer. The problem with existing umbrellas is that they must be carried separately and are heavy and awkward. It is also not uncommon for umbrellas to fall or be blown over by the wind since such umbrellas are merely embedded in the sand. Attempts to clamp the umbrella to such chairs have often resulted in cumbersome clamping means which are difficult to adjust and prone toward breakage.

Another use to which folding chairs are commonly put is as a backrest for sunbathing. For such use, people take existing chairs and turn them upside down so that the chair back becomes an inclined back and headrest while the person sits directly on the sand, ground or on a towel. However, as as the chair does not provide an extending flap such as that found on actual backrests, the force of the person leaning against the chair commonly causes the chair to slide away from the person thereby resulting in discomfort and the necessity of frequent repositioning of the inverted chair. The use of existing chairs as a backrest also results in user discomfort because the chair frame extends from the backside of the chair back panel against which the user is resting and presses against the user's arms and back. Further, as the user leans against the chair back, his head receives either no support or is supported by an existing rear leg member which is not properly aligned with the chair back for user comfort. Additionally, there is no convenient place to rest one's arms when using a conventional folding chair in an inverted backrest position.

Because of the large number of people that one commonly finds at the beach or other public recreation areas, it would be commercially desirable for companies to place advertising logos upon such chairs. Unfortunately, existing portable folding chairs do not provide good unobstructed advertising panels. When the chairs are in the upright sitting position, the chair back is inclined downwardly and the chair seat is obviously not visible. When used as a carrying device, the chair leg members and the arms of the person carrying the chair obstruct one's view of the seat panel and the arms of the person carrying the chair generally block the view of the back panel. It is no surprise therefore that the use of recreational folding chairs as an advertising media has gone heretofore unrealized. The folding chair disclosed herein not only solves all the use problems experienced with existing chairs outlined above but also provides an unobstructed panel for use as an advertising novelty.

SUMMARY OF THE INVENTION

Briefly, the invention disclosed herein comprises a multiconfiguration portable folding chair which is adapted for use as a conventional chair, a carrying device, and, in an inverted position, provides an anchored backrest which is adjustable for head and neck comfort.

It is the principal object of this invention to provide a highly versatile multi-configuration portable folding chair which is capable of comfortable use as both a conventional sitting chair and as an adjustable back rest.

It is another object of the present invention to provide a portable folding chair which is adapted for use in the folded carrying mode for carrying towels and other items.

It is yet another object of the present invention to provide a multi-configuration portable folding chair which, in use and in the carrying mode provides a visually unobstructed panel for use as an advertising medium or other visual display panel.

It is a still further object of the present invention to provide a folding chair adaptable for use in an inverted position as an adjustable backrest which carries and provides securement for a portable umbrella in both the sitting and backrest modes.

It is a still further object of the present invention to provide a multi-configuration portable folding chair having horizontal arm rests in both the upright sitting and inverted backrest positions.

It is still another object of the present invention to provide a multi-configuration portable folding chair which is light in weight, compact and economical to manufacture.

These and other objects and advantages of the present invention will become apparent from the following detailed description taken in conjunction with the accompanying drawings.

IN THE DRAWINGS

FIG. 1 is a perspective view of the chair of the present invention in its conventional seating mode.

FIG. 2 a perspective view of the chair of the present invention in the inverted backrest configuration.

FIG. 3 a perspective view of the chair of the present invention in its inverted backrest configuration illustrating the use thereof.

FIG. 4 is a side view of the chair of the present invention illustrating in solid and phantom lines the adjustability of the chair back and rear leg supports for use as a backrest.

FIG. 5*a* is an enlarged perspective view of the chair back and rear support legs adjustment cam.

FIG. 5*b* is a sectional view taken along line 5*b*—5*b* in FIG. 5*a*.

Figure 10A:
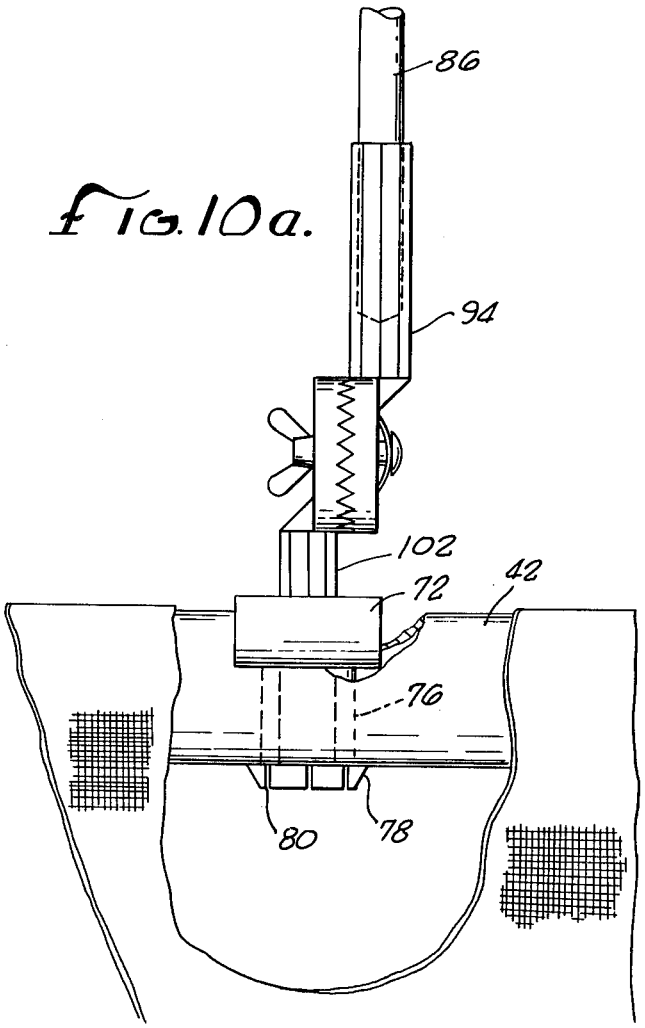

FIG. 10*a* front view of the umbrella securement and adjustment mechanism illustrated in place on the chair frame.

Figure 10B:
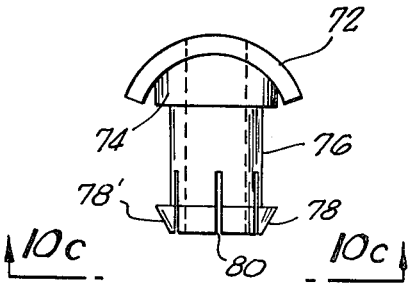

FIG. 10*b* is a side view of the umbrella mounting insert.

Figure 10C:
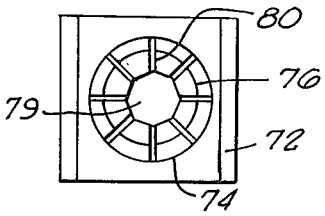

FIG. 10*c* is a bottom view of the umbrella mounting insert.

FIGS. 11–14 are perspective views of the chair of the present invention as it is folded from its conventional seating mode into the folded carrying mode.

DESCRIPTION OF THE PREFERRED EMBODIMENT

Figure 1:
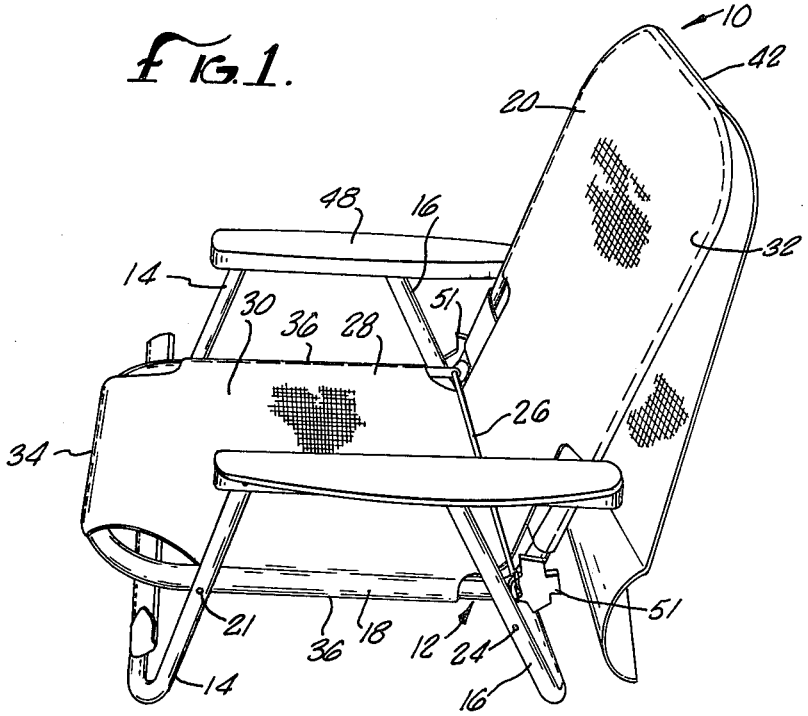

In the preferred embodiment of the invention, the multiple configuration portable folding chair 10, shown in FIG. 1 in the conventional sitting mode, has a folding frame 12 preferably constructed of a lightweight material such as tubular aluminum. The folding frame 12 is comprised of a U-shaped front leg member 14, a U-shaped rear leg member 16, a U-shaped seat member 18, and a U-shaped back member 20. The front leg member 14 is pivotally secured to the seat member 18 by pin 21 (see FIG. 2). The rear leg member 16 is pivotally secured to both the seat member 18 and back member 20 by means of a support bar 22. Support bar 22 is pivotally secured to the rear leg member 16 adjacent its lower end by pin 24. A transverse bar 26 extends between the open ends of the U-shaped seat and back members 18 and 20 through apertures therein and through an aperture in support bar 22 adjacent its upper end to pivotally interconnect the rear leg member 16, seat member 18 and back member 20. Through such pivotal mountings, the chair 10 can be deployed in the seating mode illustrated in FIG. 1 and folded into the carrying mode illustrated in FIG. 14 as depicted in FIGS. 11 through 14.

Figure 2:
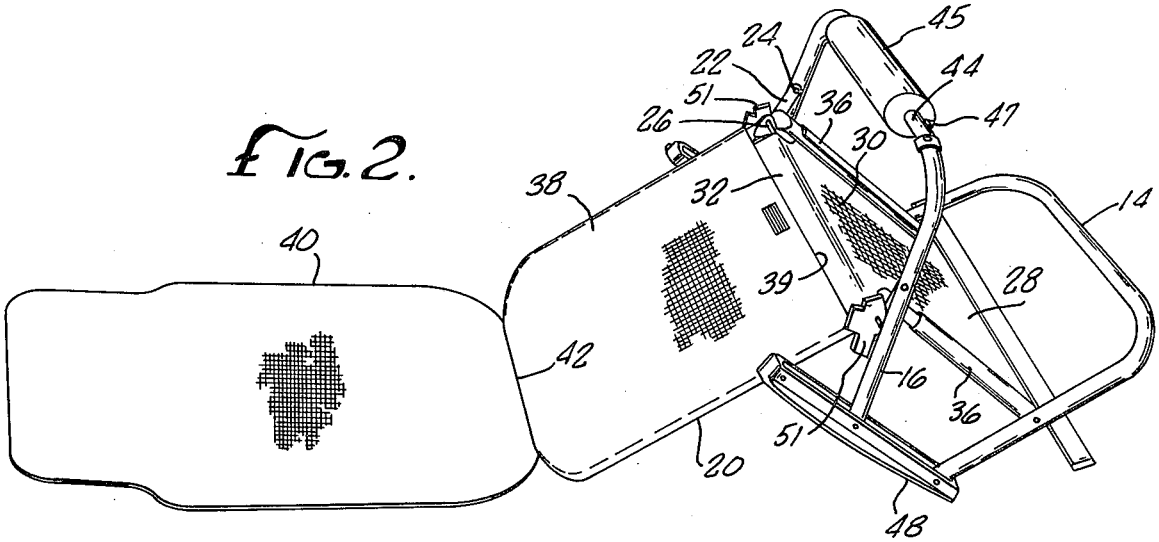
Figure 6:
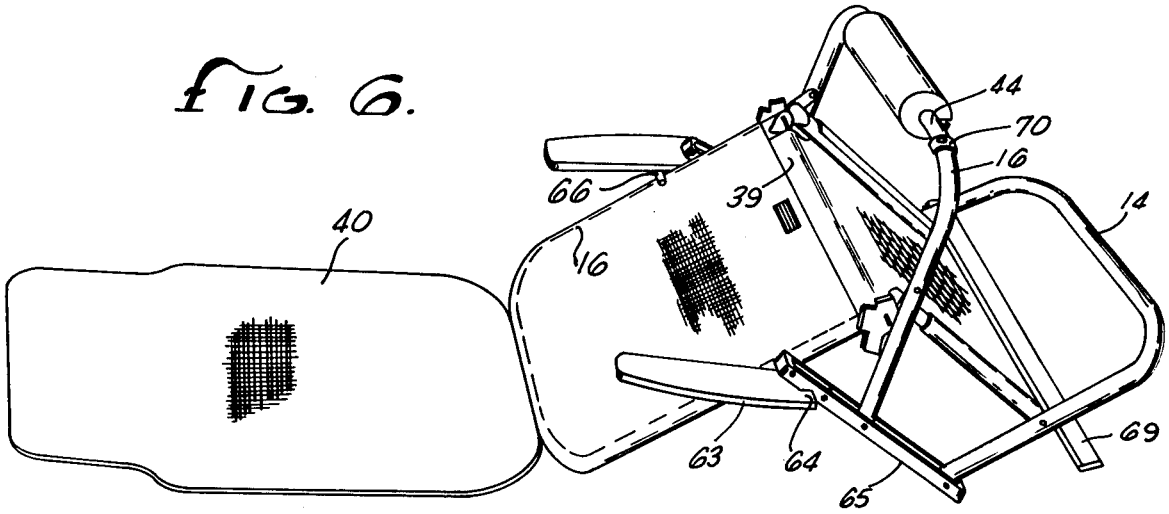
FIG. 6 is a perspective view of the chair of the present invention illustrating the use of the arm rests in the backrest mode.
Figure 7:
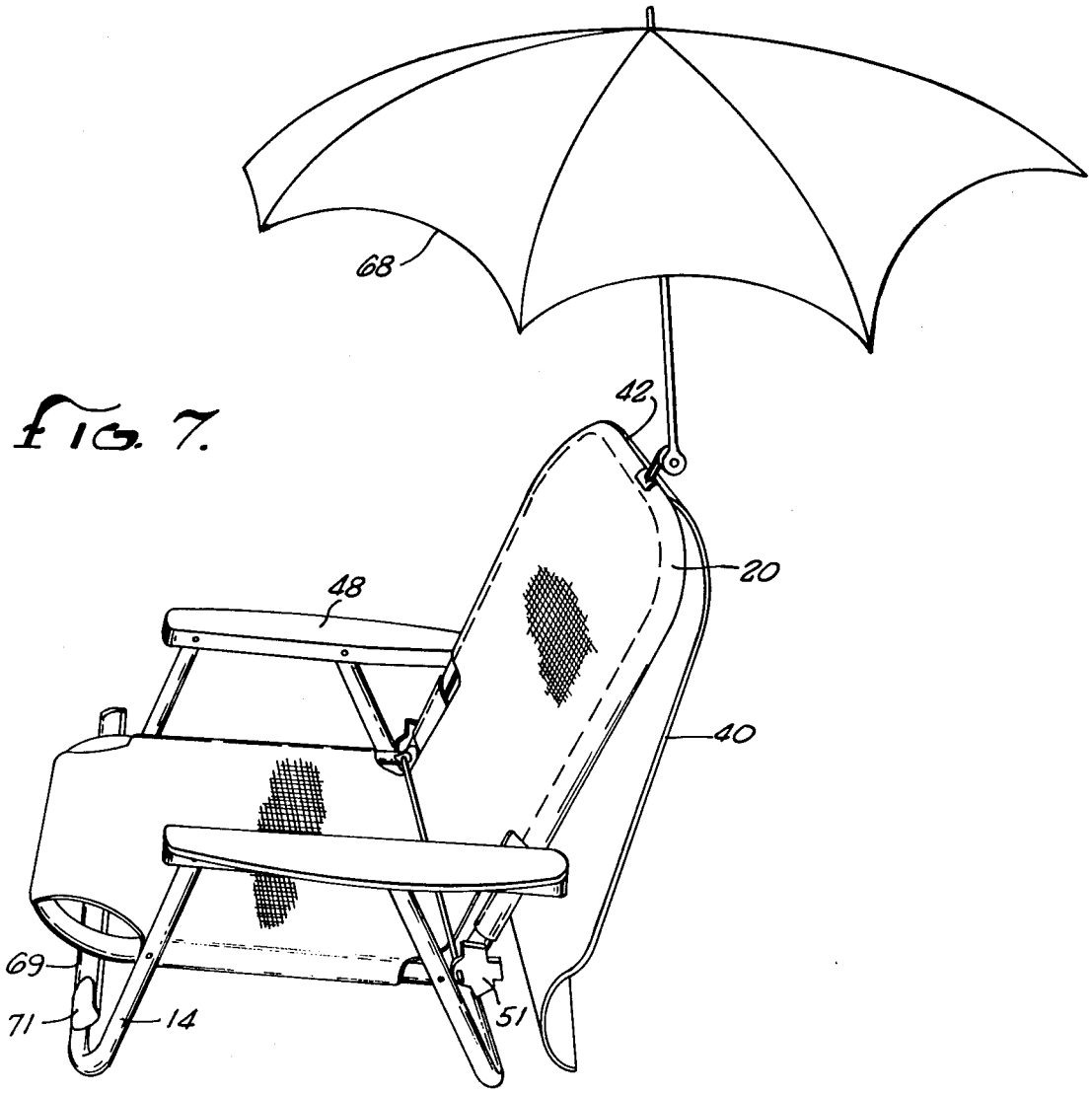
FIG. 7 is a perspective view of the chair in the sitting mode with the portable umbrella secured thereto.

A panel 28 of suitable fabric material is stretched across seat member 18, under transverse bar 26 and over the back member 20 to define a seat panel 30 and back panel 32 for the chair. As seen in FIG. 1, panel 30 is pulled over and about the forwardmost bar portion 34 of the U-shaped seat member 18 and secured by stitching or other suitable fastening means. Similarly, the lateral edges of the seat portion 30 are pulled over and about the leg portions 36 of the U-shaped seat member 18 and similarly secured. The back panel portion 32 of panel 28 is similarly secured along its uppermost edges and lateral edges about back member 20 thereby securing in place the panel 28 to define firm but comfortable seat and back panels 30 and 32. A second back panel 38 is similarly secured on the backside of back panel 20 so as to provide a comfortable backing for use of the chair in the inverted position as a backrest which extends across the frame as best seen in FIGS. 2 and 6. Back panel 38 with back panel 32 also defines an open carrying compartment 39 into which numerous different items can be secured when the chair is folded into the carrying mode shown in FIG. 14. Additionally, an elongated flap panel 40 is secured by stitching or other suitable fastening means to the elevated bar portion 42 of the U-shaped back member 20.

To use the chair 10 as a backrest, the chair is inverted as illustrated in FIG. 2. In this position, the flap 40 is extended along the ground away from the back panel 32 to function as a lounging mat and securement for the back rest. The lounging mat not only separates the user of the chair from the ground or sand but, by virtue of the weight of the user on the mat, holds the inverted chair in place thereby solving one of the problems which has heretofore prevented folding mats from properly functioning as a backrest. In addition, in this backrest mode the second back panel 38 provides a comfortable flat surface for the user and obviates the problem heretofore created by the frame on conventionl folding chairs being disposed forwardly from the seat panel in the inverted position which is very uncomfortable.

As is also seen in FIG. 2, the bar portion 44 of the U-shaped rear leg member 16 functions in the inverted backrest mode as a headrest. To increase user comfort, a cylindrical hollow headrest member 45 constructed of a pliable material such as foam rubber can be disposed about a bar portion 44. To facilitate attachment of the headrest member 45 to the frame, an open slot 47 is provided in the wall of the headrest member. As indicated above, because the elongated flap 40 is attached to the back member portion of the frame, the chair cannot easily slide and the force applied by one leaning against the back panel 32 is transferred to the arm rest 48 which, in the inverted position, dig into the ground to provide a firmly fixed yet quite comfortable backrest.

As is shown in FIG. 3, the rear leg member 16, now serving as a head support, is inclined too far forwardly to provide optimal comfort for the user. Accordingly, means 50 are provided for adjusting the angular orientation of the rear leg member with respect to the back panel 32. This adjusting means 50 comprises a pair of cams 51 one of which is pivotally mounted adjacent each end of the transverse bar 26 on each side of the chair. One of cams 51 is illustrated in detail in FIG. 5. As seen therein, the cam is provided with an aperture 52 for pivotal mounting on the transverse bar and additionally includes multiple flat lobes of varying or equal length. In the embodiment of the cam illustrated in FIG. 5, three such lobes are illustrated at 54, 56 and 58. The perimeter portion of each of the lobes is concave as illustrated at 60 to mate with the cylindrical tubular configuration of the chair frame. Each of the cams are rigidly affixed to the transverse bar 26 by a suitable connection such as roll pin 62 which passes through each cam and the respective ends of the transverse bar 26. As seen in FIG. 1, when the chair 10 is being used in the conventional seating mode, the cams are in their inoperative position. When the chair is inverted to the backrest mode, the headrest defined by the rear leg member 16 extends too far forward for comfort. Accordingly, the cams are rotated clockwise bringing the concave surface of the shortest lobe 58 into contact with the tubular support leg 16. Such rotation of the cams 51 cause the rear leg member 16 through its pivotal connection with the support bars 22 to rotate in a clockwise direction with respect to the ground while the transverse bar 26 is elevated thereby steepening the angle of the back panel 32. Continued rotation of cams 51 to bring lobe 56 and subsequently lobe 58 into contact with the rear leg member 16 results in further pivotal movement of the rear leg and a steepening of the angle of the back panel. The extremes of this movement are illustrated in FIG. 4. As can be seen in by the phantom lines thereon, when lobe 58 is brought into contact with the rear leg member 16, the back panel 32 and the bar portion 44 of the rear leg defining the headrest are brought into alignment for maximum relaxation while lobes 56 and 54 provide intermediary adjustments for the angular orientation of the back panel and headrest. It is to be understood that additional lobes could be provided on cams 51 for further varying the angular relationship between the headrest and back panel of the chair in its inverted backrest position.

For additional comfort, the chair 10 in its inverted backrest mode can be provided with arm rests as shown in FIG. 6. In the embodiment illustrated, arm rests 63 are shorter than the conventional chair arm rests 48 shown in FIG. 1 and are pivotally secured to the arm rests supports 65 at 64. In the seating mode, arm rests 63 rests atop arm support 65 and provide the conventional arm support. In the inverted backrest position, the shorter arm rests 63 are pivoted clockwise with respect to supports 65 to a horizontal disposition and a slidably mounted pin 66 in each of arm rests 63 is moved inwardly over the leg portion of the U-shaped back member 16 thereby supporting the arm rest in place in a horizontal disposition. It is to be understood that other pivotal and locking means could be employed for the deployment and securement of armrest 63 in the horizontal disposition while the chair is being used in the backrest mode.

Figure 11:
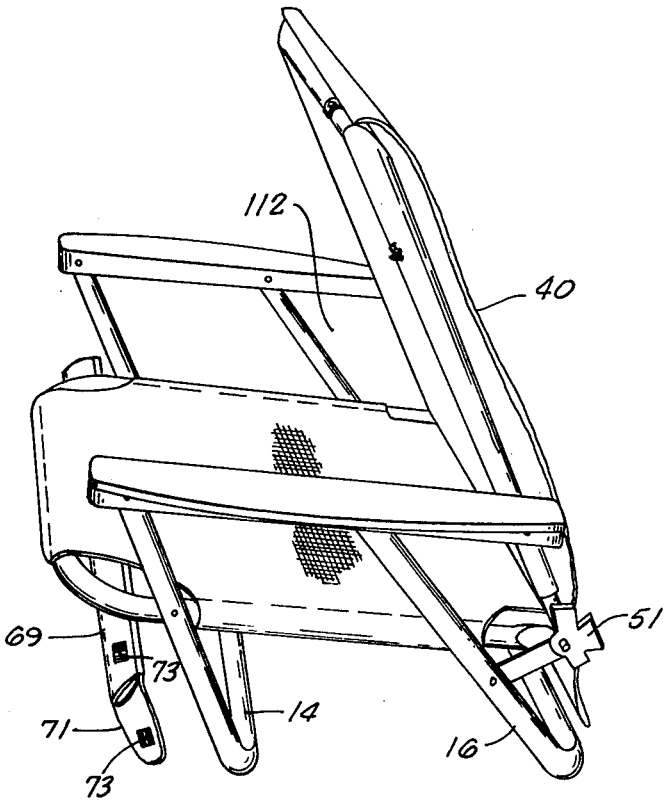

Chair 10 is also adapted for use in both the sitting and backrest modes with a portable umbrella 68. To facilitate carrying the umbrella, a tubular pouch 69 is provided on chair 10 forwardly of leg member 14 and below seat member 18. Such a pouch can be formed of the same material as panel 28 and held thereto by stitching or other suitable fastening means. The open end of pouch 69 is provided with a flap 71 which, as seen in FIG. 11, is provided with a suitable closure means such as hook and pile fastenes commonly referred to as velcro for securing the umbrella in place within the pouch 69.

For securement of the umbrella to the chair both in the sitting and backrest modes, both the bar shaped portions 42 and 44 of the back and rear leg members 20 and 16 are each provided with an apertures extending therethrough for the insertion of an umbrella insert support member 70 preferably constructed of a plastic or nylon material. The umbrella insert support 70 is best seen in FIGS. 10*a*–10*c* and is comprised of a curvilinear end portion 72, head portion 74, a cylindrical extension 76 and a lower button portion 78 provided with slits 80 therein.

To provide a secure fitting of the inserts 70 to the chair frame, the apertures extending through the bar portions 42 and 44 of the back member 20 and rear leg member 22 are formed with a stepdown drill to provide apertures having two openings through the tubular frame of different radial dimensions. Each aperture defines an inlet opening for the insertion of the insert 70 which has equal to the diameter of the head portion 74 of the insert 70 and an outlet opening equal to the diameter of the cylindrical extension 76 of insert 70 which, as can be readily seen in FIG. 10*b*, is less than the diameter of the head portion 74. The button portion 78 of insert 70 has an inwardly tapered end wall 78' extending about the perimeter thereof to facilitate installation. Accordingly, the inserts 70 can be extended through the apertures in the frame such that the button portion 78 passes through the laser inlet opening without deformation, is compressed inwardly due to the slots 80 therein as it passes through the smaller outlet opening whereupon it expands thereby securing the insert 70 in place. Due to the mating of the curved end portion 72 with the frame, the tight engagement between the head portion 74 of the insert 70 with the larger inlet opening, the tight fitting relationship between the cylindrical wall portion 76 of the insert with the smaller outlet opening of the apertures and the expansion of the button portion 78 of the insert about the outlet opening the insert is tightly secured in place and cannot be inadvertently moved with respect to the tubular framing of the chair. This tight fitting, together with the low profile of the curvilinear end portion of the inserts, allows the inserts to be secured in place in both the bar portion 42 of the back portion 26 of the frame and in the bar portion 44 of the rear leg member 16 of the frame without rendering the chair unstable in either the conventional sitting mode or the inverted back rest mode.

Figure 9:
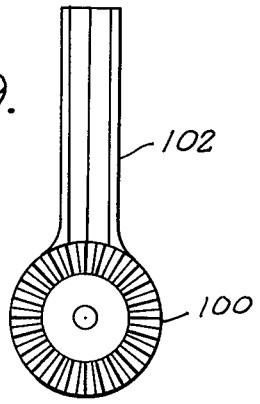
FIG. 9 is a sectional view taken through line 9—9 in FIG. 8.
Figure 8:
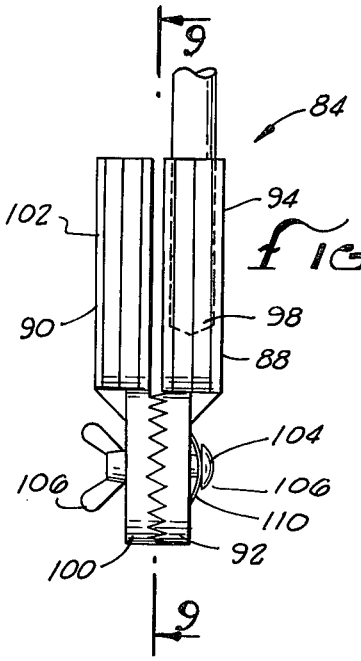
FIG. 8 is a frontal view of the umbrella securement and adjustment mechanism.

FIGS. 9 through 10 illustrate the adjustable rachet means 84 by which the umbrella shaft 86 is secured to the chair frame. As seen therein, the rachet means 84 is comprised of a pair of mating rachet members 88 and 90. The first member 88 defines a circular toothed rachet 92 at one end thereof and an extension 94 extending radially therefrom. The lower end 98 of the umbrella shaft 86 is rigidly secured in an aperture 96 within extension 94 so as to prevent any relative twisting of the shaft with respect to extension 94. The second rachet member 90 is also comprised of a circular toothed rachet 100 at one end thereof and an extension 102 extending radially therefrom. Extension 102 is octagonally shaped and adapted to fit within a correspondingly shaped aperture 79 extending through the umbrella insert support 70. The circular toothed rachet members 92 and 100 are held together by a suitable threaded fastening means 104. In the preferred embodiment of the invention, the fastening member is comprised of a bolt member 106, wing nut 108 and one or more Belville washers 110.

To secure the umbrella in place for use in either the sitting or backrest mode, the threaded fastening member 104 is loosened, the rachet members 88 and 90 are extended to the position illustrated in FIG. 10 and the threaded fastening member tightened. The octagonally shaped extension 102 on rachet member 90 is then inserted into the aperture in the umbrella insert member 70. To change the angular positioning of the umbrella, it is only necessary to loosen the fastening means 104 and readjust the mated circular tooth rachets 92 and 100 which varies the angular relationship between the extension 92 and 104 of the umbrella adjustment means 84 to effectively tilt the umbrella. The degree of tilt merely depends on the angular relationship; between the two extensions 91 and 104. The positioning of the then tilted umbrella can be readily varied by merely pulling the umbrella and adjustment means 84 from the insert 70, rotating the umbrella to the desired angular orientation and reinserting the extension 102 into aperture 79. Through this configuration, a highly adjustable and durable umbrella support configuration is provided which is capable of withstanding winds without disorientation.

Figure 12:
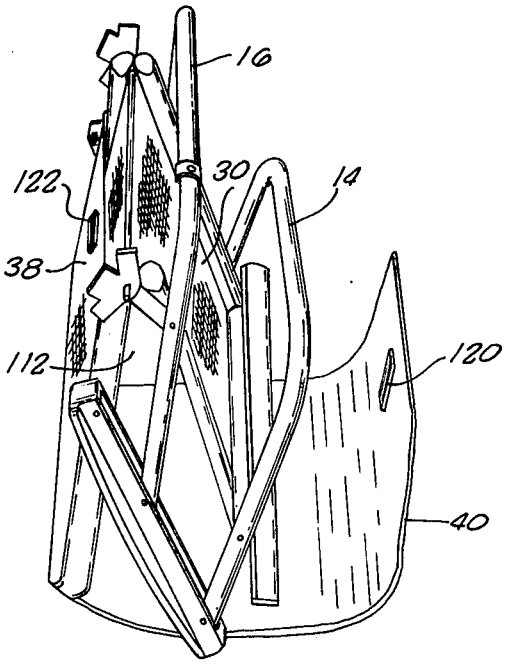

FIGS. 11 through 14 illustrate the folding capability of the chair for use in the carrying mode. FIG. 11 shows the chair being collapsed from the sitting mode to its portable folding configuration. If desired, towels and other objects can be placed between the seat and back panels of the chair which define a "V"-shaped carrying compartment 112 therebetween. The flap 40 is then lifted over the rear leg member 16 and the chair is then turned upside down as illustrated in FIG. 12. In this configuration, any towel or other objects held between the chair seat and back are held in place within the compartment 112 by the extended flap 40. In the upside down position, additional storage is provided by the storage pocket 39 defined by the forward and rear panels 32 and 38 carried by and secured to the U-shaped seat member 18 as above described.

Figure 13:
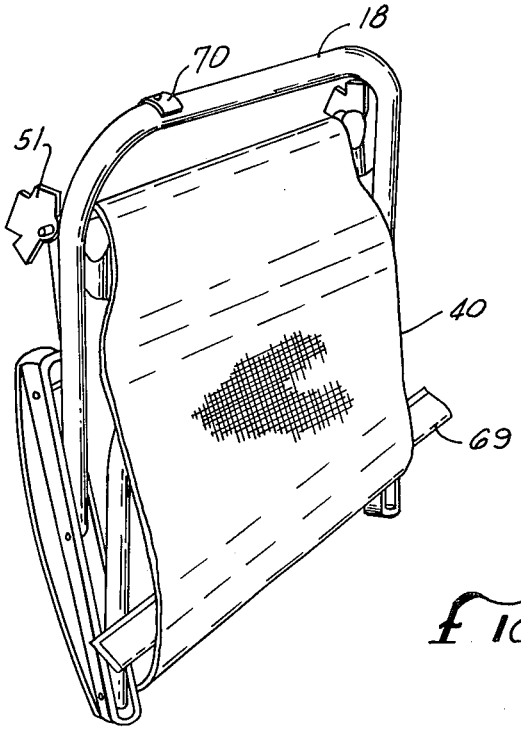
Figure 14:
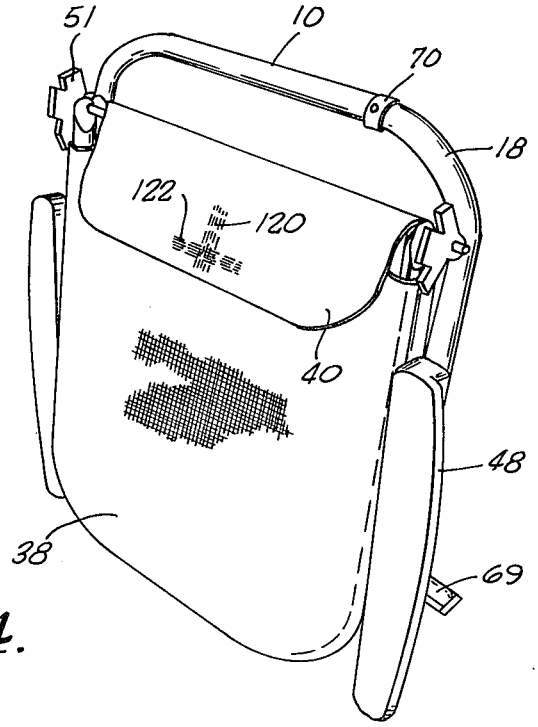

The seat flap 40 is then directed under the front leg member 14 and pressed against back panel 38 as seen in FIG. 13. As is illustrated in FIGS. 12 and 14, a first hook of pile or velcro strip 120 is secured to the underside of flap 40 parallel to the longitudinal axis thereof. A second hook and pile or Velcro strip 122 is secured to the lower end of the back panel 38 adjacent and parallel to the opening of storage pocket 39. This cruciform relationship between the locking strips 120 and 122 allows the flap to be secured in place as illustrated in FIG. 14 and provided with a tightening adjustment corresponding to the length of velcro strip 120. This adjustability allows the flap 40 to be tightened about the storage compartment 112 both when the compartment is empty and filled to varying degrees with towels and other items. As seen in FIG. 14, the chair 10 in the carrying mode readily functions as a carrying device with the rear leg member 18 serving as a convenient handle.

As seen in the drawings, the seat flap 40 is virtually unobstructed in the sitting and carrying modes and blocked only by the legs of the user in the backrest position. Accordingly, flap 40 provides not only an anchor for the chair in the backrest mode and a cover for the pocket compartment 112 in the carrying mode, but also provides an unobstructed panel for use in advertising. Advertising logos or other novelty sayings may be placed on the flap 40 by different desired means including the commercially known process such as Plastisol or Sublimation. It is believed that these techniques will allow logos to be placed on both sides of the flap 40 thereby allowing the advertising logo to be clearly visible when the chair is used in the sitting position illustrated in FIG. 1.

While the preferred embodiment of the present invention has been disclosed and illustrated in the drawings, various changes and modifications may be made without departing from the spirit and scope of the invention. Insofar as these changes and modifications are within the purview of the appended claims, they are to be considered as part of the present invention.

I claim:

1. A portable folding chair adapted for use in a conventional chair sitting mode, in an inverted backrest mode and in a carrying mode, said chair comprising:

a frame including a seat member, rear back member, front leg member and rear leg member, said seat member being pivotally secured to said back member, said front leg member being pivotally secured to said seat member and said rear leg member being pivotally secured to said seat member and said back member such that said chair frame can be collapsed froma seating mode to a carrying mode;

at least one cam member pivotally mounted on said chair adjacent the ends of said seat member and said back member and including a plurality of lobes thereon adapted to be selectively engaged with said rear leg member for varying the angular relative orientation of said rear leg member and said back member such that when using the chair in the inverted backrest mode, the rear leg member defines a headrest and the desired angular orientation between said headrest and said back member can be obtained for maximizing comfort in the backrest mode;

a flap member secured at one end thereof to said back member; and means for securing the other end of said flap member to said back member upon said chair being collapsed into said carrying mode and said flap member extended about said seat member.

2. The combination of claim 1 including a tranverse rod extending across said chair and through said seat and back members for providing a pivotal securement between said seat and back members adjacent the lateral sides of said chair, one of said cams being pivotally mounted on said rod adjacent said pivotal securements.

3. The combination of claim 1 wherein said frame is of a hollow tubular configuration and the perimeter portions of said lobes adapted to abut said seat member are of a concave configuration for mating with said frame.

4. The combination of claim 1 including a first panel carried by and extending over said seat and back members defining in the chair seating mode a chair seat and a chair back and a second panel carried by and extending over said chair back member, said second panel being spaced across said back member from said first panel and defining a backrest for said chair in the inverted backrest mode and, with said first panel, a carriage compartment.

5. The combination of claim 4 wherein said first panel, said flap and said flap securement means define in said carrying mode an expansible covered "V"-shaped carrying compartment.

6. The combination of claim 1 wherein said flap means in said seating and carrying modes defines an unobstructed advertising panel.

7. The combination of claim 1 including an umbrella, means for selectively securing said umbrella to said back member or said rear leg member for use in the sitting or backrest modes, and means for varying the angular orientation of said umbrella with respect to said chair in said sitting and backrest modes.

8. The combination of claim 1, including an umbrella, an umbrella adjustment assembly secured to said umbrella and a pair of mounting brackets, one of said brackets being carried by said back member and the other of said members being carried by said rear leg member and each of said brackets defining a polygonally shaped receiving aperture therein, said adjustment assembly comprising a pair of elongated rachet members and means for securing together said members in a locked engagement, each of said rachet members defining a tooth rachet portion adapted to engage the corresponding portion of the other member and a radial extension, one of said extensions being secured to said umbrella and the other of said extensions defining a polygonally shaped surface corresponding to the configuration of the apertures in said mounting brackets such that by loosening said securement means, adjusting the relative angular orientation of said extensions to the desired angle and resecuring said securement means and by varying the angular orientation of said one extension within the receiving aperture in one of said mounting brackets, the orientation of said umbrella with respect to said chair can be varied in both the sitting and backrest modes.

9. A portable folding chair adapted for use in a conventional chair sitting mode, in an inverted backrest mode and in a carrying mode, said chair comprising:

a frame including a seat member, rear back member, front leg member and rear leg member, said seat member being pivotally secured to said back member, said front leg member being pivotally secured to said seat member and said rear leg member being pivotally secured to said seat member and said back member such that said chair frame can be collapsed from a seating mode to a carrying mode;

means carried by said frame for adjustably varying the angular orientation of the rear leg member and back member such that when using the chair in the inverted backrest mode, the rear leg member defines a headrest and the desired angular orientation between said headrest and said back member can be obtained for maximizing comfort in the backrest mode;

a flap member secured at one end thereof to said back member;

means for securing the other end of said flap member to said back member upon said chair being collapsed into said carrying mode and said flap member extended about said seat member;

arm rest assemblies secured to said chair adjacent the lateral side thereof, each of said asssemblies comprising a horizontal member adapted to support one's arms in the seating mode; means for pivoting said member to a horizontal position upon said chair being disposed in the inverted backrest mode to thereby provide a horizontal arm rest support for the backrest mode;

a locking member to selectively secure said horizontal members in place upon said members being pivoted to the horizontal position for use in the backrest mode.

* * * * *